US006261154B1

(12) United States Patent
McEneny

(10) Patent No.: US 6,261,154 B1
(45) Date of Patent: Jul. 17, 2001

(54) METHOD AND APPARATUS FOR MEDIA FINISHING

(76) Inventor: Jeffrey William McEneny, 3747 Moorland Dr., Charlotte, NC (US) 28226

( * ) Notice: Subject to any disclaimer, the term of this patent is extended or adjusted under 35 U.S.C. 154(b) by 0 days.

(21) Appl. No.: 09/139,369

(22) Filed: Aug. 25, 1998

(51) Int. Cl.[7] ..... B24B 1/00
(52) U.S. Cl. ..... 451/32; 451/326; 451/327
(58) Field of Search ..... 451/32, 104, 106, 451/113, 114, 326, 327, 328

(56) References Cited

U.S. PATENT DOCUMENTS

| | | |
|---|---|---|
| 3,267,551 | 8/1966 | Judge . |
| 3,305,977 | 2/1967 | Kellard et al. . |
| 3,464,674 | 9/1969 | Pick . |
| 3,516,203 | 6/1970 | Hambright . |
| 3,566,552 | 3/1971 | Hambright . |
| 4,195,447 | 4/1980 | Walther et al. . |
| 4,257,196 | 3/1981 | Walther et al. . |
| 4,428,161 | 1/1984 | Walther et al. . |
| 4,446,656 | 5/1984 | Kobayashi . |
| 4,620,394 | 11/1986 | Temme et al. . |
| 4,706,414 | 11/1987 | Muzik . |
| 4,724,041 | 2/1988 | Sherman . |
| 4,724,042 | 2/1988 | Sherman . |
| 4,818,333 | 4/1989 | Michaud . |
| 4,906,327 | 3/1990 | Michaud et al. . |
| 4,937,981 | 7/1990 | Temme . |
| 4,958,776 | 9/1990 | Walther . |
| 5,158,629 | 10/1992 | Zobbi . |
| 5,251,409 | 10/1993 | Orbank . |
| 5,305,554 | 4/1994 | Emken et al. . |

FOREIGN PATENT DOCUMENTS

| | | |
|---|---|---|
| 0845327 | 6/1998 | (EP) . |

*Primary Examiner*—Derris H. Banks
(74) *Attorney, Agent, or Firm*—Philip Summa, P.A.

(57) ABSTRACT

An apparatus and associated method are disclosed for finishing the surfaces of workpieces, and that is particularly suitable for metal workpieces. The apparatus includes a tub, finishing media in the tub, means for moving the media in the tub in a generally revolving motion in the tub, and means for positioning and rotating a workpiece to be polished in the media about an axis that is oblique to the axis about which the media revolves and without moving the position of the workpiece with respect to the tub as the workpiece rotates.

16 Claims, 2 Drawing Sheets

METHOD AND APPARATUS FOR MEDIA FINISHING

FIELD OF THE INVENTION

The present invention relates to media finishing, and in particular, relates to vibratory surface finishing of metal workpieces to produce either a surface ready for further treatment (e.g., plating or coating) or a finished article.

BACKGROUND OF THE INVENTION

"Mass" or "media" finishing are two of several terms that are used to describe techniques for finishing the surfaces of objects, particularly metal workpieces, by physically contacting the objects with a collection of solid particles, with or without the use of additional chemicals to enhance the process.

In its basic methods, mass finishing has its roots in antiquity; e.g., polishing metal articles, such as swords and armor, in rotating barrels of sand or stones.

Current techniques are generally more sophisticated and usually incorporate a motor-driven vibrating container that holds a specialized media along with appropriate chemicals that enhance the finishing capability and action of the media. U.S. Pat. Nos. 3,516,203 and 3,566,552 are exemplary of more recent techniques. Theoretically, the goal of finishing is to reduce or eliminate the amount of hand finishing that must be applied to metal articles, including articles that are to be further plated, for example, with chromium plating such as is commonly used in automobile parts. In particular, the open-style alloy wheels that have become more popular on all varieties of automobiles in recent decades are often formed in a casting technique that leaves a somewhat coarse (or indeed very coarse) surface. The coarse surface then requires appropriate treatment either to give a final appearance, or to prepare the surface for further plating or coating processes. These wheels tend to be difficult to completely finish in conventional media finishing machines, however, and usually require several steps of hand polishing and buffing, both before and after any media finishing before they are suitable either for sale as finished or after plating, painting, or other coating.

One more recent technique for media finishing is often referred to as "drag finishing." In this technique, the workpieces to be finished are immersed in and then pulled through the media, and usually without media vibration as the objects are being pulled through it (hence the term "drag"). In a typical drag conveyor, the workpieces are also rotated on spindles as they are being dragged. U.S. Pat. No. 5,251,409 is exemplary of drag finishing apparatus and techniques.

Although drag finishing is an improvement over certain earlier techniques, it creates a characteristic problem in which the workpieces being polished tend to leave the equivalent of a wake behind them as they are dragged through the media, typically in a revolving circular pattern. Although the presence of the wake poses no practical problem when a single workpiece is being drag finished, it has significant disadvantages when several pieces or groups of pieces are following in each other's wake in a drag conveyor. The skewed pattern of the media in the wake keeps the media from presenting itself to the full face of the object being polished (or vice versa), thus either reducing the quality of the finished part or greatly extending the time required to carry out the finish, or both.

If the mass finishing process fails to remove sufficient material or otherwise fails to properly polish the surface, the workpiece generally must be hand finished with small finishing tools. The hand finishing process tends to be labor intensive, relatively slow, and generally expensive. Additionally, the hand finishing can discharge metals into the ambient surroundings. Accordingly, some jurisdictions establish regulatory limits as to how much hand finishing of metal pieces can be carried out on a periodic timed basis.

As noted above, chrome-plated wheels formed of aluminum alloy are becoming increasingly demanded in the automotive marketplace. Such wheels are typically difficult to finish because of the stylistic openings ("windows") in the wheels which often require much hand finishing. If the wheels are intended to be chrome plated, they tend to take the plating less favorably in the "low current density" area of the wheel. As a result, the chrome plating process can magnify, rather than reduce, the coarse or rough appearance in those areas. Additionally, because the chrome plating does not cover poorly finished areas very well, the prior nickel plating that supports the chrome tends to show up as a yellow-tinted area highlighting the poor plating quality of the wheel. As a result, wheels typically do not carry the level of warranty as do other parts of an automobile, and that original equipment manufacturers (OEM) often prefer to give.

In addition to OEM wheels, there is a relatively large aftermarket, particularly in the United States, for customized alloy wheels.

More specifically, sharp edges tend to be more difficult to plate or coat. Thus to the extent that a mass finishing process fails to moderate such edges, the later finishing steps will remain more difficult.

As another disadvantage, plated and clear coated finishes all tend to exhibit disadvantages at certain edges and corners of three-dimensional objects.

Accordingly, a need exists for a mass finishing technique that can successfully and completely finish all of the custom and difficult-shaped portions of certain object such as automobile wheels and do so in a manner that either successfully supports later plating or coating, or that produces a finished wheel that has little or no need of hand finishing (or of other mechanical finishing such as relatively expensive robotic belting or buffing machines) prior to marketing and use.

The invention meets this object with an apparatus and associated method for finishing the surfaces of workpieces and that is particularly suitable for metal workpieces with complex shapes such as automobile wheels. The apparatus comprises a tub, finishing media in the tub, means for moving the media in the tub in a generally revolving motion in the tub, and means for positioning and rotating a workpiece to be polished in the media about an axis that is oblique to the axis about which the media revolves, and without moving the position of the workpiece with respect to the tub as the workpiece rotates.

In another aspect, the invention is the method of mass finishing objects that comprises positioning an object in a tub of media, moving the media in a generally circular and revolving path that intersects the position of the object, and rotating the object in the media about an axis that is oblique to the axis of revolution of the media without moving the position of the object with respect to the tub.

The foregoing and other objects and advantages of the invention and the manner in which the same are accomplished will become clearer based on the following detailed description taken in conjunction with the accompanying drawings in which:

DETAILED DESCRIPTION

Figure 1:
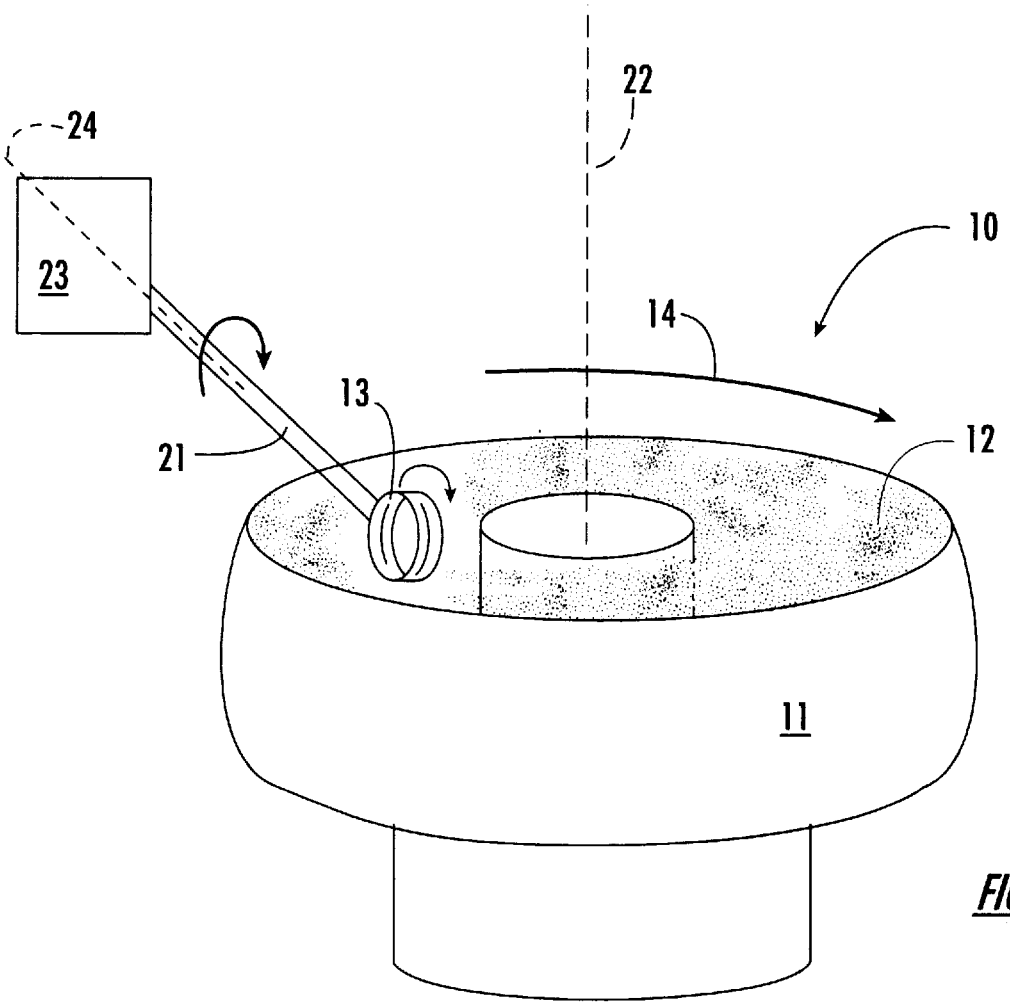
FIG. 1 is a schematic illustration of a first embodiment of the present invention.

The present invention is an apparatus for mass finishing the surface of workpieces. The apparatus is particularly suitable for metal workpieces with complex shapes of which one example are alloy wheels for automobiles. FIG. 1 illustrates a first embodiment of the device broadly designated at 10. The device comprises a container or tub 11 which FIG. 1 illustrates as being circular or toroidal in its shape, and which—in this and related shapes—is referred to as a "bowl." In its dictionary definition, the term "toroid" refers to "a surface generated by a plane closed curved rotated about a line that lies in the same plane as the curve but does not intersect it" (Merriam-Webster's Collegiate Dictionary, $10^{th}$ Edition, 1993). The shape is more colloquially referred to as resembling a doughnut. It will be understood that although a toroid is the best method of describing the shape of this embodiment of the bowl 11, that the invention is not limited to this particular shape nor should the term "toroid" as used herein, be limited to structures that meet the rigorous mathematical definition. Those familiar with solid geometry and the like will of course recognize that the functional equivalent of a toroid could be made using slightly different shapes, but that these would fall within the claims of the invention. Other container shapes that can be used with the present invention include, but are not limited to, troughs, ovals, and racetrack shapes.

The tub 11 holds a finishing media which is generally designated by the dotted portions 12. The finishing media is a collection of small objects, usually selected to be uniform in shape, size, and composition, which strike a workpiece to be finished and carry out a polishing or abrading action upon it. The nature and type of finishing media selected for use with the invention is not critical to the invention, but exemplary media include natural stone, sand, porcelain, ceramic particles, metal balls, certain natural organic media (e.g. walnut shells), or polymer-based materials. The individual pieces of the media are also referred to as "working bodies" to differentiate them from the workpieces being finished. In FIG. 1, the workpiece to be polished is illustrated as the open wheel 13. It will be understood that although a simple open wheel is illustrated, the invention offers significant advantages for alloy wheels of much more complex shape, and that the simple illustration of FIG. 1 is included for schematic and illustrative purposes rather than as any limitation of the claimed invention.

The invention further comprises means for moving the media 12 in the tub 11 in a generally revolving motion that is indicated by the arrow 14 in FIG. 1. The control of the media 12 in the tub 11 is generally well understood in this art and will not be discussed in greater detail herein. Exemplary discussions of the manner in which the motion of the tub 11 can be used to move the media 12 are set forth, for example, in U.S. Pat. No. 3,464,674 at Column 3, line 26 though Column 4, line 38. See also, U.S. Pat. No. 4,428,161.

Figure 2:
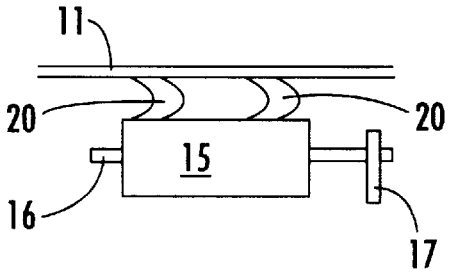
FIG. 2 is a schematic diagram of the means for moving the tub and the media.

The most typical method of moving the media is with an arrangement that is schematically illustrated in FIG. 2. FIG. 2 illustrates a motor 15 that has a motor shaft 16 with an eccentrically mounted weight 17 on one (or both) ends of the shaft 16. The motor 15 is flexibly connected to the floor of the tub 11 using any appropriate connectors 20. When the motor is operating, the eccentric position of the weight 17 on the shaft 16 causes the motor 15 to vibrate and in turn pass this vibration on to the tub 11 and the media 12. As set forth in the above-referenced U.S. Pat. No. 3,464,674, the positioning of the weight 17 on the shaft 16 and the amount of eccentricity included therein changes the vibrational pattern of the tub 11 and the media 12 in a manner that is generally well understood in this art. Accordingly, those of ordinary skill in this art are expected to be able to control the media in a manner as described herein without undue experimentation.

The invention next includes means shown as the rotating shaft or spindle 21 for positioning and rotating the workpiece 13 that is to be polished in the media 12. The shaft 21 rotates the workpiece 13 about an axis 24 that is oblique to the axis 22 about which the media revolves, and does so without moving the position of the workpiece 13 with respect to the tub 11 as the workpiece rotates. It has been discovered according to the present invention that this orientation creates a high pressure of the media 12 against the workpiece 13, and that the vibrating action of the tub 11 maintains a flow of media 12 to the wheel 13 at all times. Furthermore, because the workpiece is not being dragged through the media, the invention avoids creating the wake (and its problems) characteristic of drag finishing. The rotation of the wheel 13 can be reversed to maximize work coverage on the important surfaces. In contrast to drag finishing and related methods which tend to leave a wake or dead spot of media behind the workpiece 13, the present invention quickly recovers the media flow to the next workpiece and allows maximum media flow to, through, and around the workpiece.

In this regard it will be understood that the workpiece 13 will likely undergo small movements with respect to the tub or bowl (i.e. rotation, oscillation, or change of presentation angle) but does not move in any translational manner through the media using the bowl as the point of reference.

Based on observations to date, the invention also reduces the attrition rate of the media used in the apparatus and related method. Although the reasons are not yet fully understood. it appears that in contrast to drag finishing (which produces a relatively high wear rate from the plowing action of the moving part on the media), the apparatus of the invention allows the media 12 to finish the workpiece 13 without plowing up against it.

The invention also provides the advantage of subjecting the entire workpiece 13 to the finishing process. As a result, the polishing produces a radius on all corners that is advantageous for subsequently applied coating such as chrome plate. In this manner, the invention permits a more even coating thickness on the corners of the workpiece and eliminates stress raisers at the edges. Absent such finishing, plated finishes can quickly peel from edges that are not adequately "broken" (i.e., taken to an appropriate radius rather than being left as a sharp corner).

FIG. 1 also illustrates schematically mean 23, typically a motor, for rotating the spindle 21 and the workpiece 13 around the spindle axis 24 that is, as noted above, oblique to the tub axis 22.

As recognized by those familiar with mass finishing, the process is typically enhanced with various chemical compositions such as burnishing compositions, polishing compositions, cutting compositions, or loose or suspended (i.e. in a gel) abrasives, as well as with more specific compositions referred to as "accelerators." The nature and use of these compositions or of accelerators is generally well understood in this art and any appropriate composition or accelerator can be selected for use with particular finishing media and particular workpieces by those of ordinary skill in this art and without undue experimentation. U.S. Pat. Nos. 4,724,041 and 4,724,042 are generally exemplary, but not limiting, of the types of compounds that are useful as accelerators.

In preferred embodiments, the apparatus 10 includes a plurality of spindles 21 for handling a plurality of workpieces 13. Because the apparatus avoids creating wakes or dead spots behind the respective workpieces 13, the use of the invention with a plurality of spindles is particularly advantageous, particularly as compared to drag finishing. The positioning and driving of the spindles 21 is a straightforward mechanical arrangement and will not otherwise be described in detail.

In the preferred embodiments, the angle of the spindle can be changed to most effectively complement the action of the media 12 on the workpiece 13. Changing the angle of the spindle effectively changes the angle of presentation of the workpiece to the media flowing past it even though the workpiece remains in the same position with respect to the tub as the media moves around it.

Figure 3:
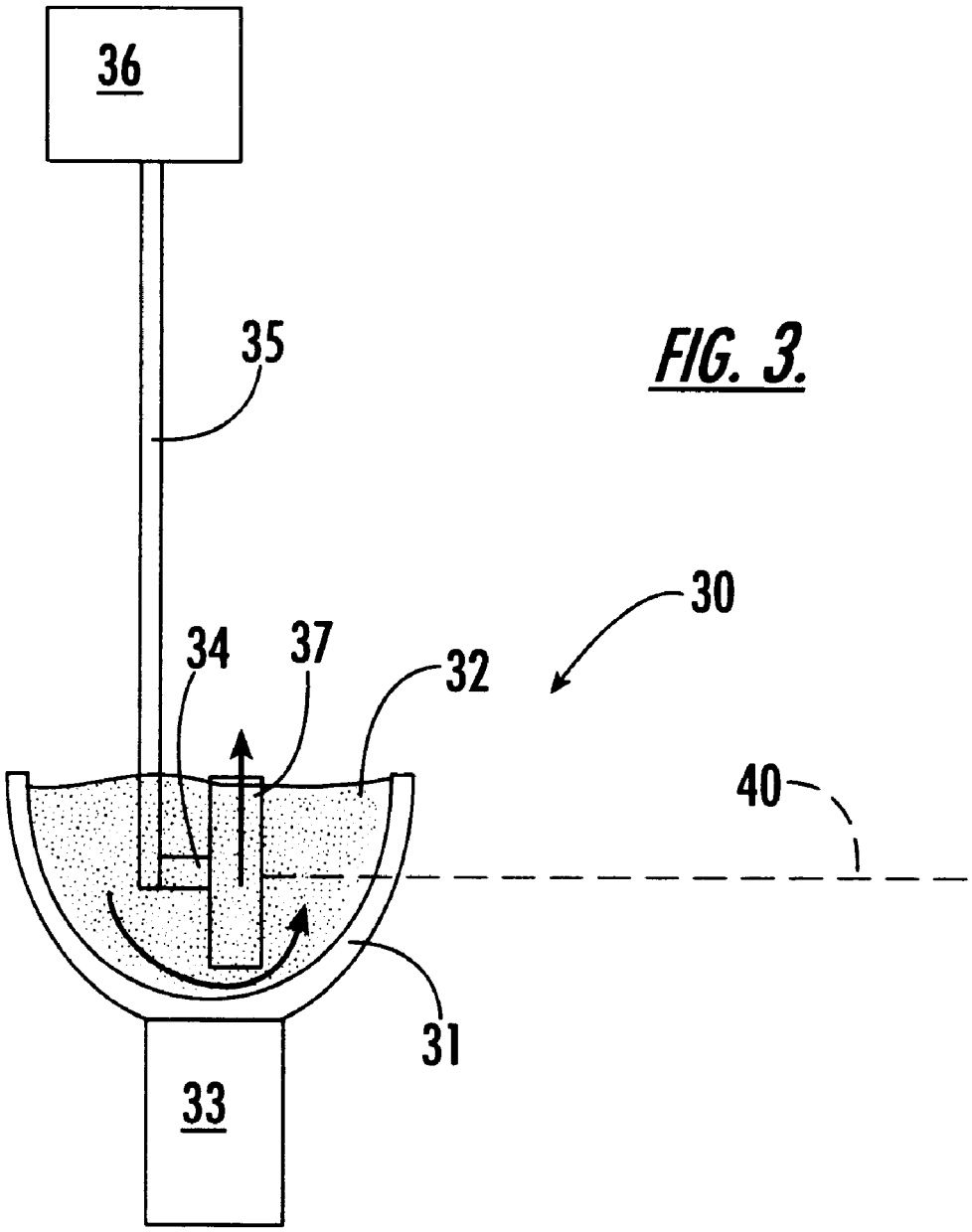
FIG. 3 is a cross-sectional schematic illustration of a second embodiment of the present invention.

FIG. 3 shows a second embodiment of the invention broadly designated at 30. In this embodiment, the tub 31 is horizontally positioned and generally cylindrical in shape with the cylinder having an axis normal to the cross-sectional schematic view of FIG. 3. In this embodiment, a preferred finishing media 32 comprises metal balls which are typically used for burnishing or peening metal workpieces. As in the previous embodiment, the apparatus 30 includes means 33 for vibrating the tub 31 in a pattern that urges the ball media to move in a revolving fashion around the horizontal axis of the cylindrical tub 31. A shaft 35 with a rotating head 34 extends into the ball media and FIG. 3 illustrates that the head 34 and shaft 35 are driven by an appropriate power source such as a motor 36. The manner of using the motor 36 and shaft 35 to rotate the head 34 and the workpiece 37 in the media 32 are generally well understood mechanical arrangements and will not be otherwise described in detail. The motor and shaft 35 drive the rotating head in an orientation in which the workpiece 37 rotates about an axis illustrated at 40 that is oblique to the horizontal axis of the tub 31 and without moving the position of the rotating head 34, and thus without moving the position of the workpiece 37, with respect to the tub 31 as the workpiece rotates.

As in earlier embodiments, the apparatus can comprise a plurality of rotating heads 34 for polishing a plurality of workpieces 37 at the same time. The angle between the axis of rotation of the workpiece 40 and that of the cylindrical tub 31 can likewise be changed to present the workpiece 37 in a slightly different orientation to the revolving media 32.

The embodiment of FIG. 3 is particularly useful for—but not limited to—ball finishing because the rotation of the workpiece 37 helps moderate the peening effect that the metal balls otherwise would have on the workpiece 37. The invention thus provides an enhanced burnishing step which can be used to complement a polishing step carried out in an apparatus such as the one illustrated in FIG. 1. Thus, it will be understood that the apparatus illustrated in FIGS. 1 and 3 can be used in repetitive, alternative, sequential, or any other complementary fashion as may be desired or necessary for a particular finishing process or a particular workpiece.

Although the embodiment of FIG. 2 is particularly useful for ball finishing, it is not limited to such, and the media 32 can again be selected from the group consisting of sand, stone, metal, porcelain, natural organic materials, ceramics, and polymer-based compositions.

As in the first embodiment, an arrangement such as that illustrated in FIG. 2 can be used to produce the desired vibrating motion of the tub 31 and the media 32.

In yet another aspect, the invention comprises a method of mass finishing objects which comprises positioning an object or workpiece in a tub of polishing media, moving the media in a generally circular and revolving path that intersects the position of the object, and rotating the object in the media about an axis that is oblique to the axis of revolution of the media without moving the position of the object with respect to the tub. As noted above, the method is preferably enhanced with a chemical composition or accelerator.

In the drawings and specification, there have been disclosed typical embodiments of the invention, and, although specific terms have been employed, they have been used in a generic and descriptive sense only and not for purposes of limitation, the scope of the invention being set forth in the following claims.

That which is claimed is:

1. An apparatus for finishing the surfaces of workpieces, and that is particularly suitable for polishing the surfaces of metal workpieces, said apparatus comprising:

a toroidal tub;

finishing media in said toroidal tub;

vibrating means for moving said media in said tub in a generally revolving helical motion in said tub;

means for positioning a workpiece to be polished in said media and rotating the workpiece in said media about an axis that is oblique to and does not intersect with the axis about which said media revolves and without moving the position of the workpiece with respect to said tub as the workpiece rotates.

2. An apparatus according to claim 1 wherein said positioning and rotating means comprises a rotating shaft.

3. An apparatus according to claim 2 comprising a plurality of said rotating shafts.

4. An apparatus according to claim 2 and further comprising means for changing the oblique angle.

5. An apparatus according to claim 1 wherein said media is selected from the group consisting of: sand, stone, metal, porcelain, natural organic materials, ceramics and polymeric compositions.

6. An apparatus according to claim 5 wherein said media further comprises a chemical composition.

7. An apparatus according to claim 1 wherein said media moving means comprises:

a motor flexibly mounted to said tub and having a motor shaft; and an eccentrically-mounted weight on said motor shaft for vibrating said motor and said tub.

8. An apparatus according to claim 1 wherein the shape of said tub is selected from the group consisting of: toroids, bowls, troughs, ovals and racetrack shapes.

9. An apparatus for finishing the surfaces of workpieces, and that is particularly suitable for polishing the surfaces of metal workpieces with complex shapes, said apparatus comprising:

a horizontally positioned toroidal bowl, the center of which defines a vertical axis;

a finishing media in said bowl;

means for vibrating said bowl in a pattern that urges said media to move in revolving helical fashion around said vertical axis of said bowl.

two rotatable spindles positioned to extend into said media in said bowl obliquely to but non-intersecting with said vertical axis of said bowl, each said spindle having means for mounting a workpiece thereon with the workpiece in said finishing media; and means for rotating said spindles and the workpieces thereon in said finishing media as said media revolves in said bowl and without moving the position of the spindle with respect to the bowl as the workpiece rotates.

10. An apparatus according to claim 9 wherein said bowl is toroidal in shape.

11. An apparatus according to claim 9 and further comprising means for changing the oblique angle of said spindles.

12. An apparatus according to claim 9 wherein said media is selected from the group consisting of: sand, stone, metal, ceramics and polymeric compositions.

13. An apparatus according to claim 12 wherein said media further comprises a chemical accelerator composition.

14. An apparatus according to claim 9 wherein said media moving means comprises:

a motor flexibly mounted to said tub and having a motor shaft; and an eccentrically-mounted weight on said motor shaft for vibrating said motor and said tub.

15. A method of mass finishing objects comprising:

positioning an object in a tub of finishing media;

moving the media in a generally helical and revolving path that intersects the position of said object while;

vibrating the moving media as it revolves; and while;

rotating the object in the media about an axis that is oblique to and does not intersect with the axis of revolution of the media without moving the position of the object with respect to the tub.

16. A method according to claim 15 and further comprising adding a chemical composition to the polishing media.

* * * * *